US006974205B2

(12) United States Patent
Dodd

(10) Patent No.: US 6,974,205 B2
(45) Date of Patent: Dec. 13, 2005

(54) PRINTHEAD EMPLOYING BOTH SLOTTED AND EDGEFEED FLUID DELIVERY TO FIRING RESISTORS

(75) Inventor: Simon Dodd, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 655 days.

(21) Appl. No.: 09/795,344

(22) Filed: Feb. 27, 2001

(65) Prior Publication Data

US 2002/0118257 A1 Aug. 29, 2002

(51) Int. Cl.[7] ..... B41J 2/155; B41J 2/21; B41J 2/05

(52) U.S. Cl. ..... 347/42; 347/43; 347/65

(58) Field of Search ..... 347/56, 63, 65, 347/43, 67, 87, 40, 42, 20, 61, 85

(56) References Cited

U.S. PATENT DOCUMENTS

| | | | | | |
|---|---|---|---|---|---|
| 4,463,359 A | | 7/1984 | Ayata et al. | ..... | 347/56 |
| 4,931,811 A | | 6/1990 | Cowger et al. | ..... | 347/93 |
| 4,965,610 A | | 10/1990 | Ishikawa | ..... | 347/61 |
| 5,025,271 A | * | 6/1991 | Baker et al. | ..... | 347/87 |
| 5,218,376 A | | 6/1993 | Asai | ..... | 347/61 |
| 5,278,584 A | * | 1/1994 | Keefe et al. | ..... | 347/63 |
| 5,659,345 A | | 8/1997 | Altendorf | ..... | 347/87 |
| 5,754,202 A | | 5/1998 | Sekiya et al. | ..... | 347/63 |
| 5,793,393 A | | 8/1998 | Coven | ..... | 347/65 |
| 6,267,468 B1 | * | 7/2001 | Torgerson et al. | ..... | 347/43 |

* cited by examiner

*Primary Examiner*—Stephen D. Meier
*Assistant Examiner*—Blaise Mouttet

(57) ABSTRACT

A printhead includes a substrate having a plurality of fluid heating elements and at least one peripheral edge. Fluid channels deliver fluid to the plurality of fluid heating elements. The plurality of fluid channels includes at least one edgefeed fluid channel defined by the at least one peripheral edge, and at least one slot feed fluid channel.

27 Claims, 7 Drawing Sheets

PRINTHEAD EMPLOYING BOTH SLOTTED AND EDGEFEED FLUID DELIVERY TO FIRING RESISTORS

TECHNICAL FIELD

This invention relates generally to printing systems. In particular, the present invention is a printhead that delivers fluid to the heating elements using both slotted and edgefeed fluid channels.

BACKGROUND OF THE INVENTION

Throughout the business world, inkjet printing systems are extensively used for image reproduction. Inkjet printing systems frequently make use of an inkjet printhead mounted within a carriage that is moved back and forth across print media, such as paper. As the printhead is moved across the print media, a control system activates the printhead to deposit or eject ink droplets onto the print media to form images and text. Such systems may be used in a wide variety of applications, including computer printers, plotters, copiers and facsimile machines.

Ink is provided to the printhead by a supply of ink that is either carried by the carriage or mounted to the printing system such that the supply of ink does not move with the carriage. For the case where the ink supply is not carried with the carriage, the ink supply can be in fluid communication with the printhead to replenish the printhead or the printhead can be intermittently connected with the ink supply by positioning the printhead proximate to a filling station to which the ink supply is connected whereupon the printhead is replenished with ink from the refilling station.

For the case where the ink supply is carried with the carriage, the ink supply may be integral with the printhead whereupon the entire printhead and ink supply is replaced when ink is exhausted. Alternatively, the ink supply can be carried with the carriage and be separately replaceable from the printhead.

For convenience, the concepts of the invention are discussed in the context of thermal inkjet printheads. A thermal inkjet printhead die includes an array of firing chambers having orifices (also called nozzles) which face the print media. The ink is applied to individually addressable ink energizing elements (such as firing resistors) within the firing chambers. Energy provided by the firing resistors heats the ink within the firing chambers causing the ink to bubble. This in turn causes the ink to be expelled out of the orifice of the firing chamber toward the print media. As the ink is expelled, the bubble collapses and more ink is drawn into the firing chambers, allowing for repetition of the ink expulsion process.

Inkjet printhead dies are in part manufactured using processes that employ photolithographic techniques similar to those used in semiconductor manufacturing. The components are constructed on a flat substrate layer of silicon by selectively adding layers of various materials and subtracting portions of the substrate layer and added layers using these photolithographic techniques. Some existing inkjet printhead dies are defined by a silicon substrate layer having firing resistors within a stack of thin film layers, a barrier layer and an orifice layer or orifice plate. Material removed from the barrier layer defines the firing chambers, while openings within the orifice layer or plate define the nozzles for the firing chambers.

In an inkjet printhead die, ink is delivered to the firing chambers and thereby the firing resistors by either a slotted ink delivery system or an edgefeed ink delivery system. In a slotted ink delivery system, the inkjet printhead die includes one or more slots that route ink from a backside of the printhead die to a front side where the firing resistors reside on at least one side of each of the slots. Typically, a single color printhead die includes a single ink delivery slot with one column of firing resistors on each side of the slot. However, a single color printhead die may include multiple slots to improve print quality and/or speed. A multicolor printhead die typically includes an ink delivery slot for each color. Generally, the printhead die is mounted to a printhead cartridge body using a structural adhesive. In multicolor print cartridges having a printhead die with multiple slots, this structural adhesive is deposited in a loop around each individual slot to separate out the individual ink colors.

Although this slotted ink delivery system for inkjet printhead dies adequately delivers ink the firing resistors, there are some disadvantages to this system of ink routing. The primary disadvantages are strength, size and waste. With regard to strength, in a printhead die, the ink delivery slot(s) structurally weaken the printhead die. As such, the greater the number of slots the weaker the die. With regard to size, the ink delivery slots can only be put so close together before manufacturability issues arise that causes manufacture of the printhead die to be accomplished in less than an optimal cost efficient manner. As such, the spacing of the ink delivery slots limits how small the printhead die can be. With regard to waste, approximately 300 $\mu$m of printhead die material (i.e. silicon) is lost by creating a slot. As such, the greater the number of slots, the greater the waste.

In an edgefeed ink delivery system, ink is routed from a backside of the printhead die, then around the edges of the die to a front side of the die where the firing resistors reside. Typically in an edgefeed ink delivery system, only the two long edges of the printhead die are used for ink feed, while the two short edges of the die are used for electrical connections. As such, the typical edgefeed printhead die includes only a single column of firing resistors adjacent each long edge. Since there are only two edges for ink flow, an edgefeed printhead die is limited to a maximum of two color inkjet printing, while in practice, the use of an edgefeed printhead die is almost exclusively used for single color printing. Generally, the orifice plate of the printhead die is oversized to permit mounting of the printhead die to a printhead cartridge body using a structural adhesive.

The edgefeed ink delivery system for inkjet printhead dies adequately delivers ink to the firing resistors. Moreover, edgefeed printhead dies have a large strength and utility advantage over slotted printhead dies because unlike slotted dies there are no ink delivery slots in an edgefeed die to weaken the die or cause waste. In addition, edgefeed printhead dies have a size advantage over slotted dies because the absence of ink delivery slots allows the edgefeed die to be made smaller. However, there is a disadvantage to the edgefeed die when compared to the slotted die, since the edgefeed die is limited to a maximum of two color printing while that slotted die can print as many colors as there are slots.

Typically to obtain print quality and speed, it is to necessary to maximize the density of the firing chambers (i.e. firing resistors) and/or increase the number of firing chambers. Maximizing the density of the firing chambers and/or increasing the number of firing chambers typically necessitates an increase in the size of the printhead die and/or a miniaturization of printhead die components. As discussed above, when the density is sufficiently high, conventional manufacturing by assembling separately produced components becomes more difficult and costly. In addition, the substrate that supports firing resistors, the barrier that isolates individual resistors, and the orifice plate that provides a nozzle above each resistor are all subject to small dimensional variations that can accumulate to limit miniaturization. Further, the assembly of such components for conventional printheads requires precision that limits manufacturing efficiency.

As such, there is a desire for a multicolor printhead die that is economical to manufacture, and relatively simple to incorporate into inkjet printhead cartridges usable in thermal inkjet printing systems.

SUMMARY OF THE INVENTION

The present invention is a printhead. The printhead comprises a substrate that includes a plurality of fluid heating elements. A plurality of fluid channels deliver fluid to the plurality of fluid heating elements. The plurality of fluid channels includes at least one edgefeed fluid channel and at least one slot feed fluid channel.

In one aspect of the present invention, the plurality of fluid channels includes first, second and third fluid channels. The first fluid channel is operatively associated with a first multiplicity of fluid heating elements of the plurality of fluid heating elements, with the first fluid channel being defined by a first edge of the substrate. The second fluid channel is operatively associated with a second multiplicity of fluid heating elements of the plurality of fluid heating elements, with the second fluid channel being defined by a second edge of the substrate. The third fluid channel is operatively associated with a third multiplicity of fluid heating elements of the plurality of fluid heating elements, with the third fluid channel being defined by a slot extending through the substrate. In a further aspect of the present invention, the first fluid channel delivers ink of a first color to the first multiplicity of fluid heating elements, the second fluid channel delivers ink of a second color to the second multiplicity of fluid heating elements, and the third fluid channel delivers ink of a third color to the third multiplicity of fluid heating elements. In still a further aspect of the present invention, the first, second and third fluid channels deliver ink of the same color to the first, second and third multiplicity's of fluid heating elements.

In another embodiment, the present invention provides a printhead cartridge for a printing system having a fluid supply for supplying fluid to the printhead cartridge. The printhead cartridge includes a cartridge body, and a printhead die mounted to the cartridge body. The printhead die includes a plurality of firing resistors. A plurality of fluid channels deliver fluid to the plurality of firing resistors. The plurality of fluid channels includes at least one edgefeed fluid channel and at least on slot feed fluid channel.

In a further embodiment, the present invention provides a fluid delivery system that comprises a substrate including a plurality of fluid heating elements. The substrate includes an edgefeed fluid delivery feature for delivering fluid to the plurality of fluid heating elements, and a slot feed fluid delivery feature for delivering fluid to the plurality of fluid heating elements.

In still another embodiment, the present invention provides a printhead comprising a substrate that includes first, second, third and fourth rows of firing resistors. The substrate also includes a single slot feed fluid delivery channel for delivering fluid to at least the first row of firing resistors, and at least one edgefeed fluid delivery channel for delivering fluid to at least the second row of firing resistors.

In still a further embodiment, the present invention provides a method of delivering fluid comprising the steps of providing a substrate having a plurality of fluid heating elements, delivering fluid via an edgefeed fluid delivery feature of the substrate to the plurality of fluid heating elements, and delivering fluid via a slot feed fluid delivery feature of the substrate to the plurality of fluid heating elements.

This printhead die substantially minimizes the size, strength and waste issues associated with present slotted printhead dies. In particular, the first, second and third fluid channels of the printhead die of the present invention permits three color printing with a printhead die having only a single slot as compared to the three slots needed for three color printing in a typical slotted printhead die. The elimination of two slots allows the printhead die of the present invention to exhibit an overall size reduction, as well as an increase in strength and a reduction in waste. In addition, the printhead die of the present invention substantially eliminates the single ink color or two ink color limitations of typical edgefeed printhead dies. Moreover, the printhead die of the present invention provides the above features throughout the useful life of the printhead cartridge to which the printhead die is mounted so as to preclude premature replacement of the printhead cartridge and the associated cost. Lastly, the printhead die of the present invention is relatively easy and inexpensive to manufacture, and is relatively simple to incorporate into printhead cartridges used in thermal inkjet printing systems.

BRIEF DESCRIPTION OF THE DRAWINGS

The accompanying drawings are incorporated in and constitute a part of this specification. The drawings illustrate the embodiments of the present invention. In the accompanying drawings like reference numerals designate like parts throughout.

DETAILED DESCRIPTION

Figure 1:
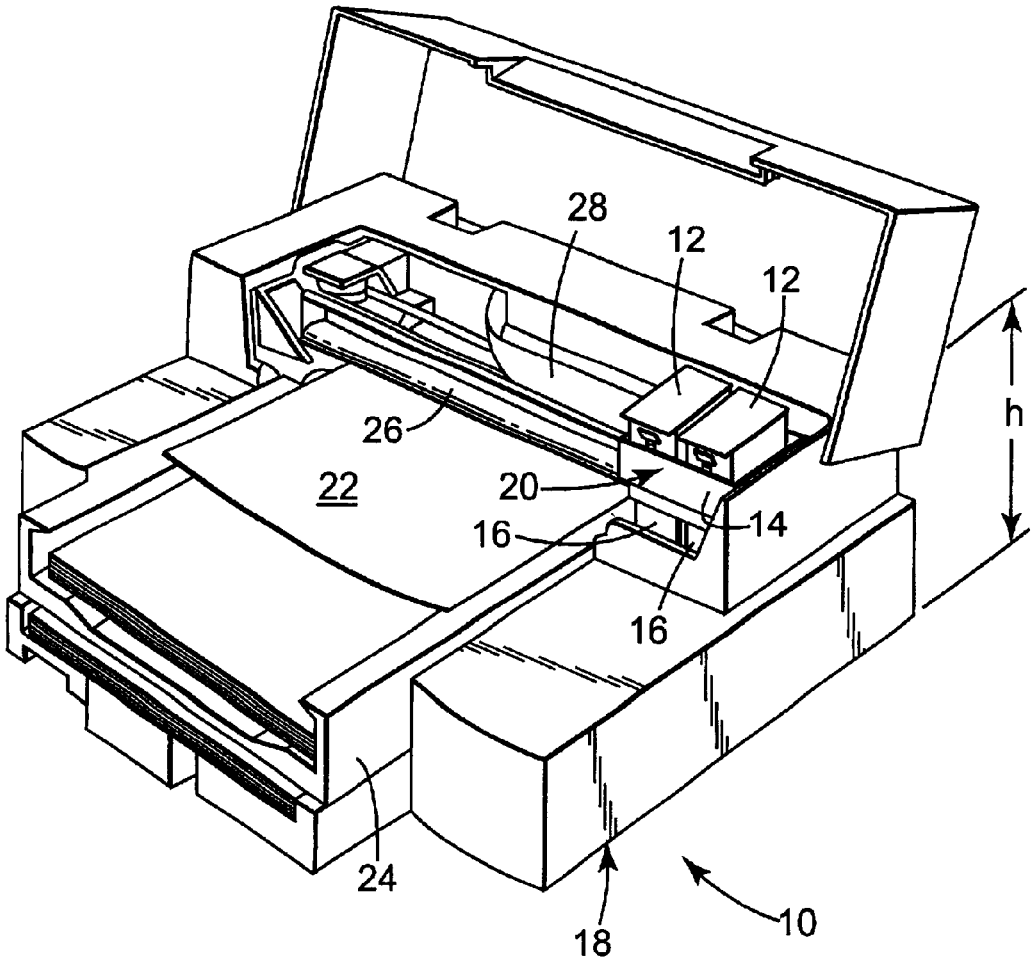
FIG. 1 is a perspective view of a printing system with a cover opened to show a plurality of replaceable fluid containers and a plurality of replaceable printhead cartridges incorporating printhead dies in accordance with an embodiment of the present invention.
Figure 2:
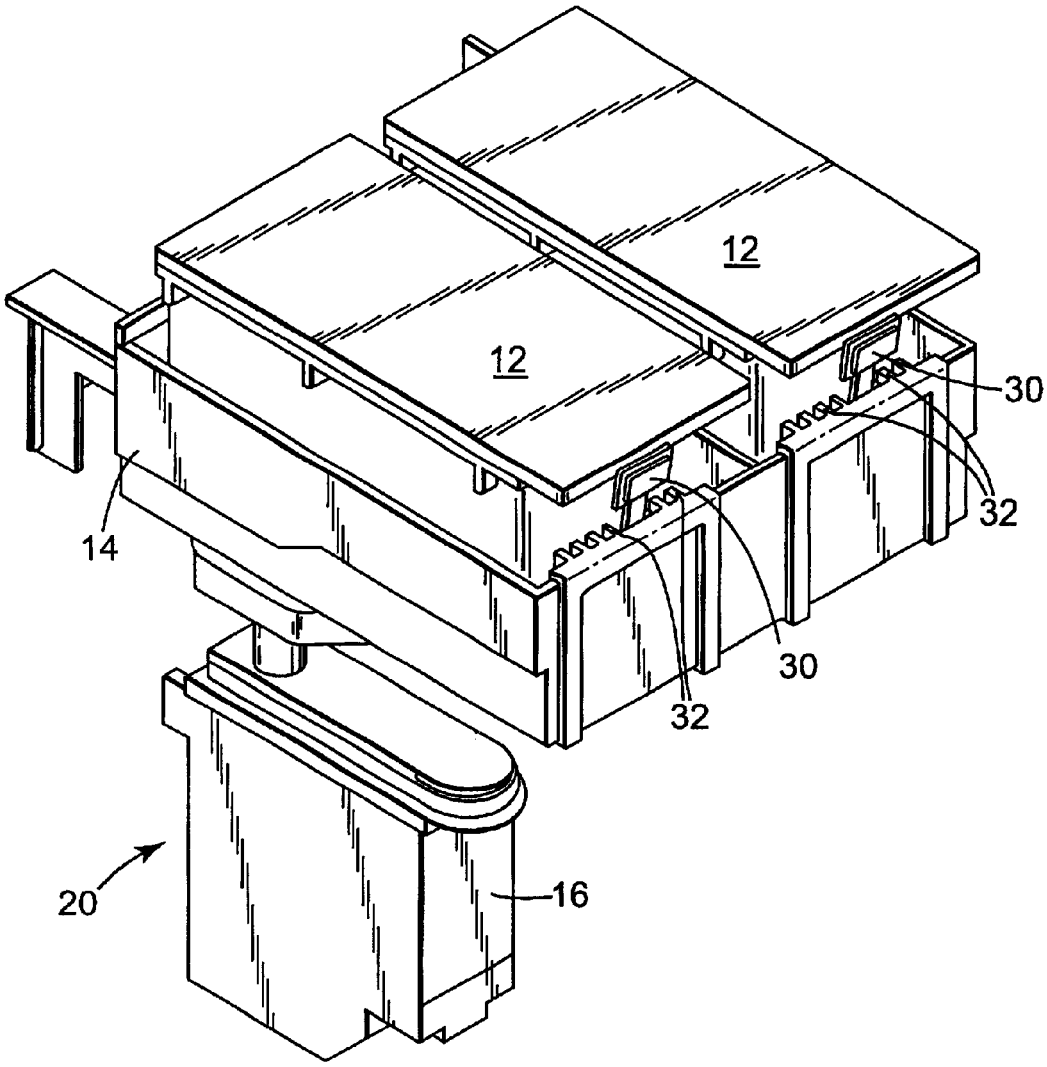
FIG. 2 is a perspective view a portion of a scanning carriage showing the replaceable fluid containers positioned in receiving station that provides fluid communication between the replaceable fluid containers and one or more printhead cartridges incorporating printhead dies in accordance with an embodiment of the present invention.
Figure 3:
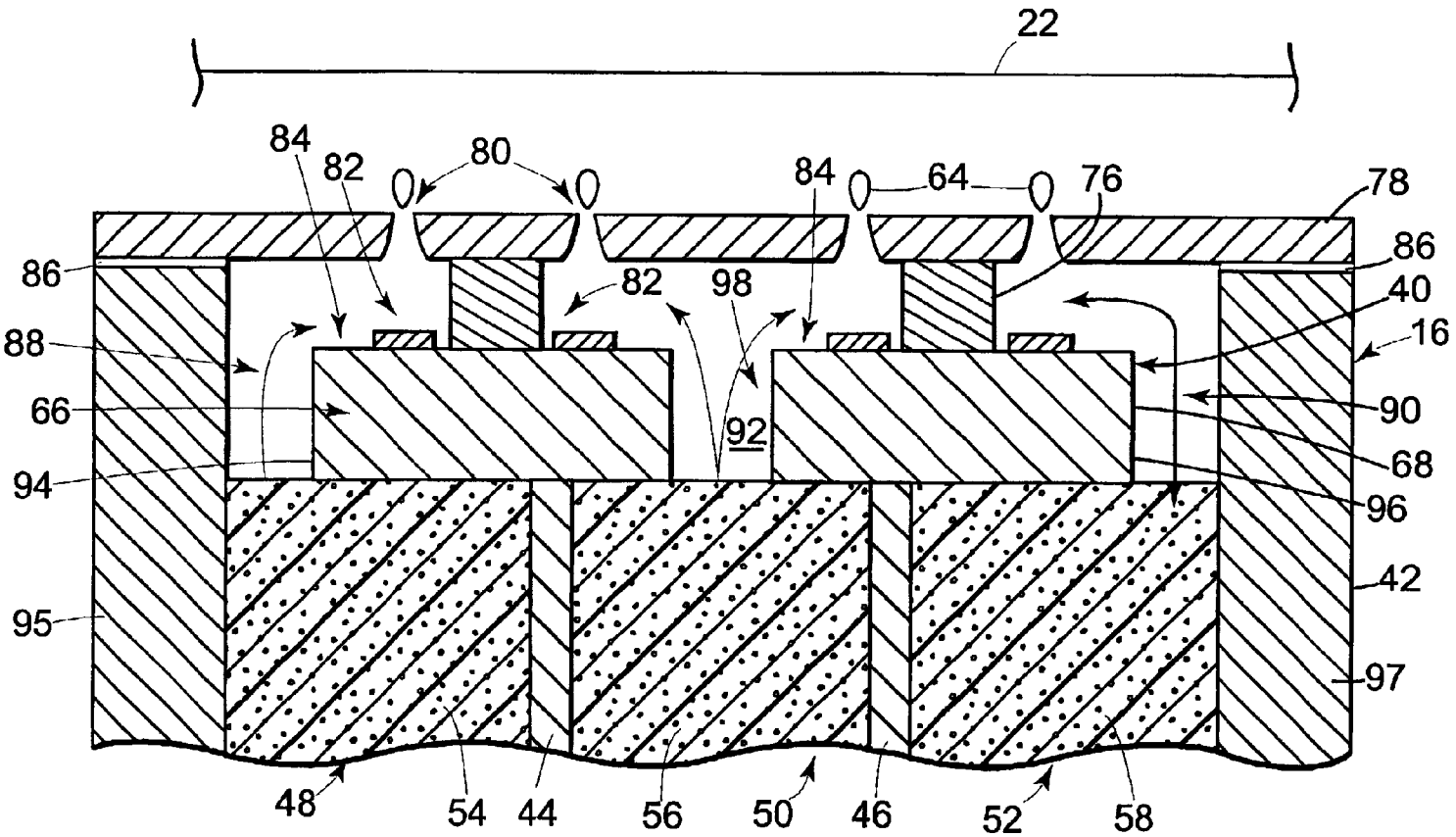
FIG. 3 is a partial sectional view of the printhead die in accordance with the present invention shown mounted to multicolor printhead cartridge of FIG. 1.

A replaceable inkjet printhead cartridge 16 useable in a thermal inkjet printing system 10 in accordance with the present invention is illustrated generally in FIGS. 1–3. The printhead cartridge 16 includes a printhead die 40 that delivers fluid to firing resistors 70 positioned within the printhead die 40 using both slotted and edgefeed ink delivery systems.

In FIG. 1, the printing system 10, shown with its cover open, includes at least one replaceable fluid container 12 that is installed in a receiving station 14. In one preferred embodiment, the printing system 10 includes two replaceable fluid containers 12, with one single color fluid container 12 containing a black ink supply, and one multi-color fluid container 12 containing cyan, magenta and yellow ink supplies. With the replaceable fluid containers 12 properly installed into the receiving station 14, fluid, such as ink, is provided from the replaceable fluid containers 12 to at least one inkjet printhead cartridge 16. In one preferred embodiment, the printing system 10 includes two replaceable printhead cartridges 16, with one single color printhead cartridge 16 for printing from the black ink supply, and one multi-color printhead cartridge 16 for printing from the cyan, magenta and yellow ink supplies.

In operation, the inkjet printhead cartridges 16 are responsive to activation signals from a printer portion 18 to deposit fluid on print media 22. As fluid is ejected from the printhead cartridges 16, the printhead cartridges 16 are replenished with fluid from the fluid containers 12. In one preferred embodiment, the replaceable fluid containers 12, receiving station 14, and the replaceable inkjet printhead cartridges 16 are each part of a scanning carriage 20 that is moved relative to the print media 22 to accomplish printing. The printer portion 18 includes a media tray 24 for receiving the print media 22. As the print media 22 is stepped through a print zone, the scanning carriage 20 moves the printhead cartridges 16 relative to the print media 22.

Each printhead cartridge 16 has an inkjet printhead die 40. The printer portion 18 selectively activates the printhead dies 40 (see FIGS. 3 and 4) of the printhead cartridges 16 to deposit fluid on print media 22 to thereby accomplish printing.

The scanning carriage 20 of FIG. 1 slides along a slide rod 26 to print along a width of the print media 22. A positioning means (not shown) is used for precisely positioning the scanning carriage 20. In addition, a paper advance mechanism (not shown) moves the print media 22 through a print zone as the scanning carriage 20 is moved along the slide rod 26. Electrical signals are provided to the scanning carriage 20 for selectively activating the printhead dies 40 of the printhead cartridges 16 by means of an electrical link, such as a ribbon cable 28.

FIG. 2 is a perspective view of a portion of the scanning carriage 20 showing the pair of replaceable fluid containers 12 properly installed in the receiving station 14. For clarity, only a single inkjet printhead cartridge 16 is shown in fluid communication with the receiving station 14. As seen in FIG. 2, each of the replaceable fluid containers 12 includes a latch 30 for securing the replaceable fluid container 12 to the receiving station 14. In addition, the receiving station 14 includes a set of keys 32 that interact with corresponding keying features (not shown) on the replaceable fluid containers 12. The keying features on the replaceable fluid containers 12 interact with the keys 32 on the receiving station 14 to ensure that the replaceable fluid containers 12 are compatible with the receiving station 14.

As seen in FIG. 3, the tri-color printhead cartridge 16 includes a cartridge body 42 having partition walls 44 and 46 that separate the cartridge body 42 into three separate chambers 48, 50 and 52. The first chamber 48 includes a first capillary member 54 for a first ink color, the second chamber 50 includes a second capillary member 56 for a second ink color, and the third chamber 52 includes a third capillary member 58 for a third ink color. The first, second and third capillary members 54, 56, 58 receive their respective color ink from the tri-color fluid container 12.

Figure 5:
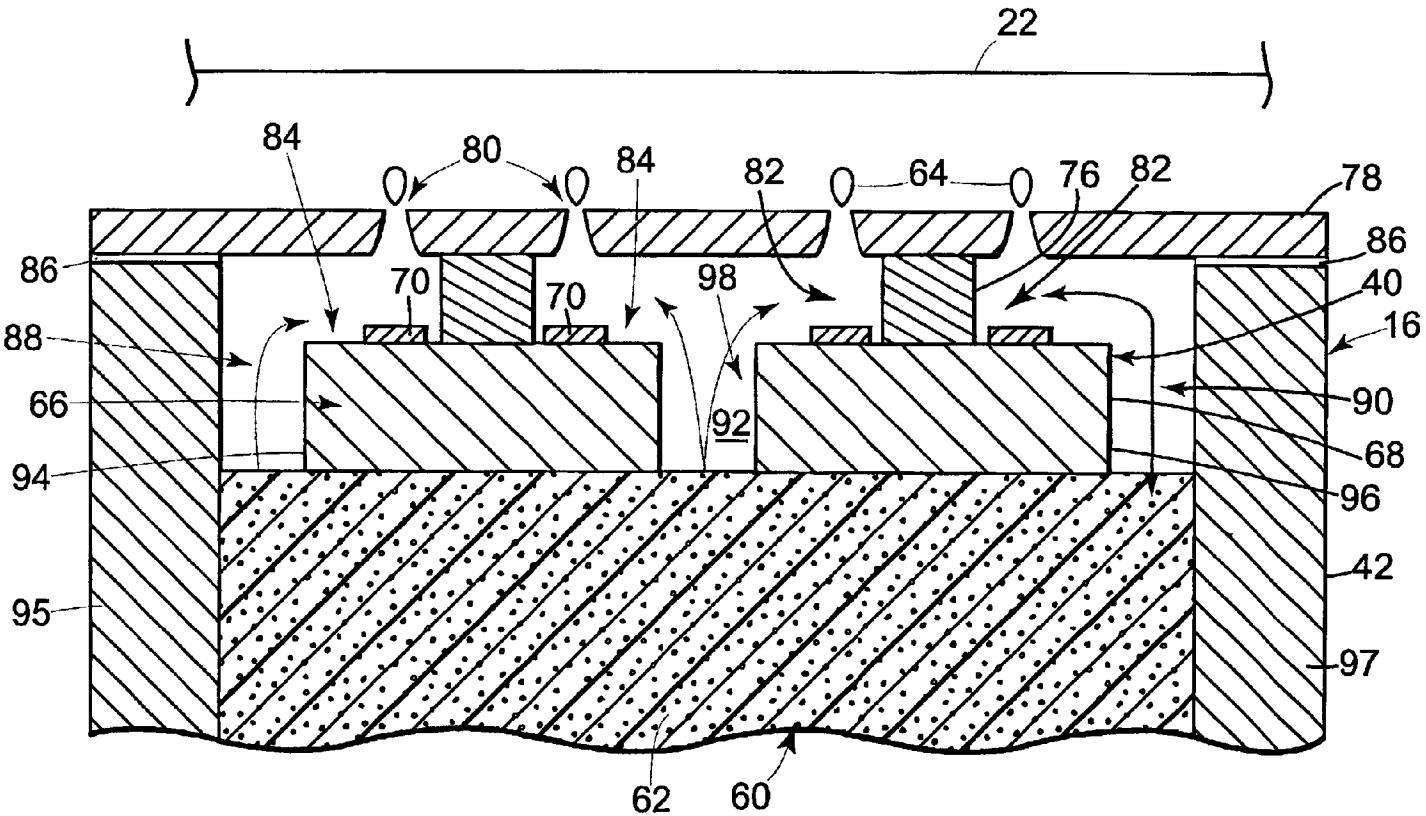
FIG. 5 is a partial sectional view similar to FIG. 3 of the printhead die in accordance with an embodiment of the pr sent invention shown mounted to a single color printhead cartridge of FIG. 1.

In FIG. 5, the cartridge body 42 of the single color inkjet printhead cartridge 16 includes a single chamber 60 having a single capillary member 62 for a single color. In one preferred embodiment, this single color is black. The single capillary member 62 receives its respective color ink from the single color fluid container 12.

As seen in FIGS. 3 and 5 each of the tri-color (FIG. 3) and single color (FIG. 5) inkjet printhead cartridges 16 includes one inkjet printhead die 40 in accordance with the present invention. Because the printhead dies 40 of the single color and tri-color printhead cartridges 16 are similar only the printhead die 40 in connection with the tricolor printhead cartridge 16 of FIG. 3 will be described with particularity.

As seen in FIG. 3, the inkjet printhead die 40 of the present invention functions to eject ink droplets 64 onto a print medium 22. The printhead die 40 is defined by a substrate 66 that includes a base layer 68, such as a semiconductor silicon substrate that provides a rigid chassis for the printhead die 40, and which accounts for the majority of the thickness of the printhead die 40. On top of the base layer 68 are a plurality of independently addressable ink energizing elements, such as firing resistors 70 (shown in FIG. 4) for heating ink to generate the ink droplets 64 in a known manner. In one preferred embodiment, the firing resistors 70 form part of a stack of thin film layers on top of the base layer 68. On top of the base layer 68 is a barrier layer 76, such as a photoresist polymer substrate. On top of the barrier layer 76 is an orifice plate 78, such as a Ni substrate.

Figure 4:
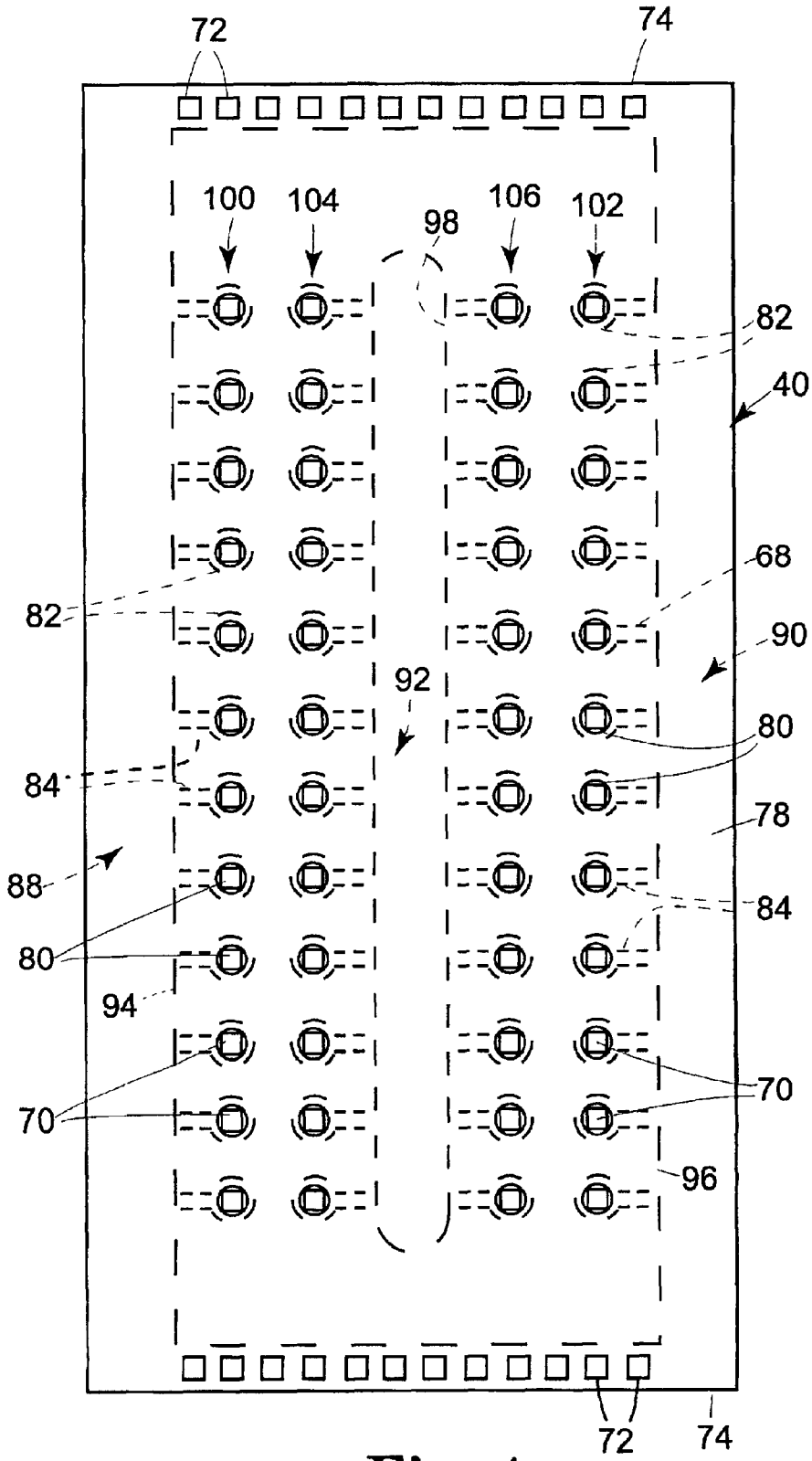
FIG. 4 is an enlarged p an view of the printhead die shown in FIG. 3.

As seen in FIG. 4, the die 40 has short side edges 74. The firing resistors 70 are electrically linked (not shown) to electrical interconnects 72 on the short side edges 74. In a known manner, the electrical interconnects 72 contact printer portion 18 contacts (not shown) to provide the energizing signals to the firing resistors 70.

As seen in FIGS. 3 and 4, the orifice plate 78 includes a plurality of nozzles 80 through which the ink droplets 64 are ejected. One nozzle 80 is associated with each firing resistor 70. The barrier layer 76 defines a plurality of firing chambers 82 for the firing resistors 70. One nozzle 80 and one firing resistor 70 is associated with each firing chamber 82. The barrier layer 76 also defines a plurality of ink feed passageways 84 for delivering ink to the firing chambers 82. In one preferred embodiment, one ink feed passageway 84 is associated with each firing chamber 82. Alternatively, multiple ink feed passageways 84 could be associated with each firing chamber 82. As seen in FIG. 3, the orifice plate 78 is oversized (i.e., larger than the barrier layer 76 and the base layer 68) to allow the inkjet printhead die 40 to be mounted to the cartridge body 42 using a suitable adhesive 86.

As seen in FIG. 3, the base layer 68 defines first, second and third ink refill channels 88, 90 and 92, respectively, for delivering ink to the plurality of ink feed passageways 84 and ultimately to the firing chambers 82 for the firing resistors 70. The first ink refill channel 88 is defined by a first long edge 94 of the base layer 68. In particular, the first ink refill channel 88 is defined between the first edge 94 of the base layer 68 and a first wall 95 of the cartridge body 42. The second ink refill channel 90 is defined by a second long edge 96 of the base layer 68. In particular, the second ink refill channel 90 is defined between the second edge 96 of the base layer 68 and a second wall 97 of the cartridge body 42. The third ink refill channel 92 is defined by a slot 98 extending through the base layer 68. As seen in FIG. 4, the third ink refill channel 92 is positioned between and extends parallel to the first and second ink refill channels 88 and 90. In essence, the first and second ink refill channels 88 and 90 are edgefeed ink refill channels, while the third ink refill channel 92 is a slot feed ink refill channel.

As seen in FIG. 4, the first ink refill channel 88 is operatively associated with a first multiplicity or column 100 of firing resistors 70 immediately adjacent to the first long edge 94 of the base layer 68 via respective ink feed passageways 84. The second ink refill channel 90 is operatively associated with a second multiplicity or column 102 of firing resistors 70 immediately adjacent to the second long edge 96 of the base layer 68 via respective ink feed passageways 84. The third ink refill channel 92 is operatively associated with a third multiplicity or at least one column of firing resistors 70. In one preferred embodiment, the third ink refill channel 92 is operatively associated with a third multiplicity of firing resistors 70 defined by two columns 104 and 106 of firing resistors 70 immediately adjacent to each side of the slot 98 extending through the base layer 68 via respective ink feed passageways 84.

For the tricolor printhead cartridge, the first, second and third ink refill channels 88, 90, 92 fluidically communicate with the first, second and third capillary members 54, 56, 58, respectively, such that the first column 100 of firing resistors 70 eject a first ink color (i.e., cyan), the second column 102 of firing resistors 70 eject a second ink color (i.e., magenta), and the third and fourth columns 104, 106 of firing resistors 70 eject a third ink color (i.e., yellow). In the single color inkjet printhead cartridge 16 of FIG. 5 there is only a single capillary member 62 with which all the ink refill channels 88, 90, 92 fluidically communicate. As such, the first, second, third and fourth columns 100, 102, 104, 106 of firing resistors 70 all eject a single ink color (i.e., black).

The inkjet printhead die 40 of the present invention substantially minimizes the size, strength and waste issues associated with present slotted printhead dies. In particular, the first, second and third ink refill channels 88, 90, 92 of the inkjet printhead die 40 of the present invention permits three color printing with a printhead die having only a single slot 98 as compared to the three slots needed for three color printing in a typical slotted printhead die. As such, the inkjet printhead die 40 can be made smaller in size then a comparable slotted only printhead die. In particular, the printhead die 40 of the present invention can exhibit a 600 $\mu$m width reduction based upon an average ink refill slot width of 300 $\mu$m.

Figure 6:
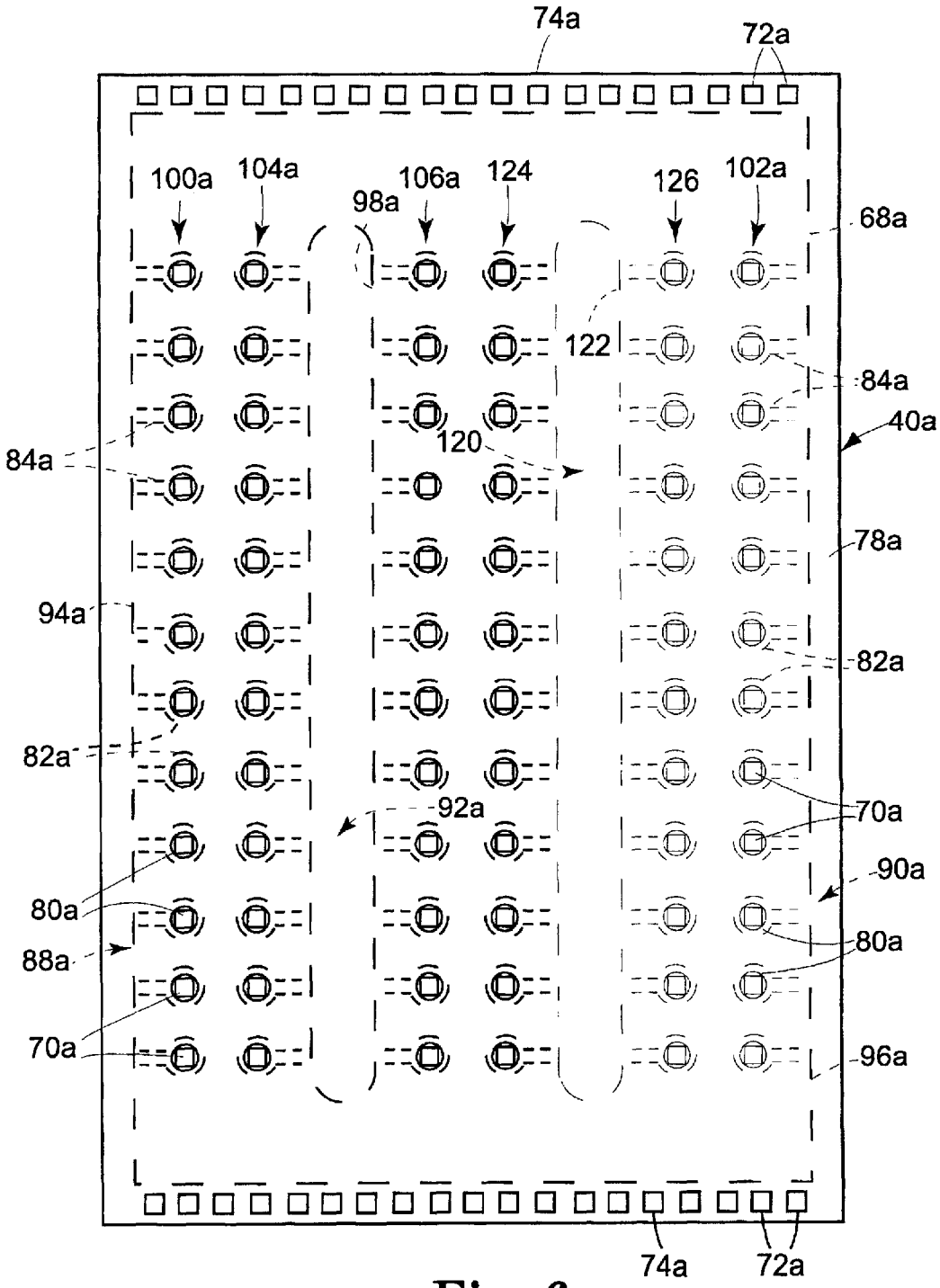
FIG. 6 is an enlarged plan view of an alternative printhead die in accordance with an embodiment of the present invention.
Figure 7:
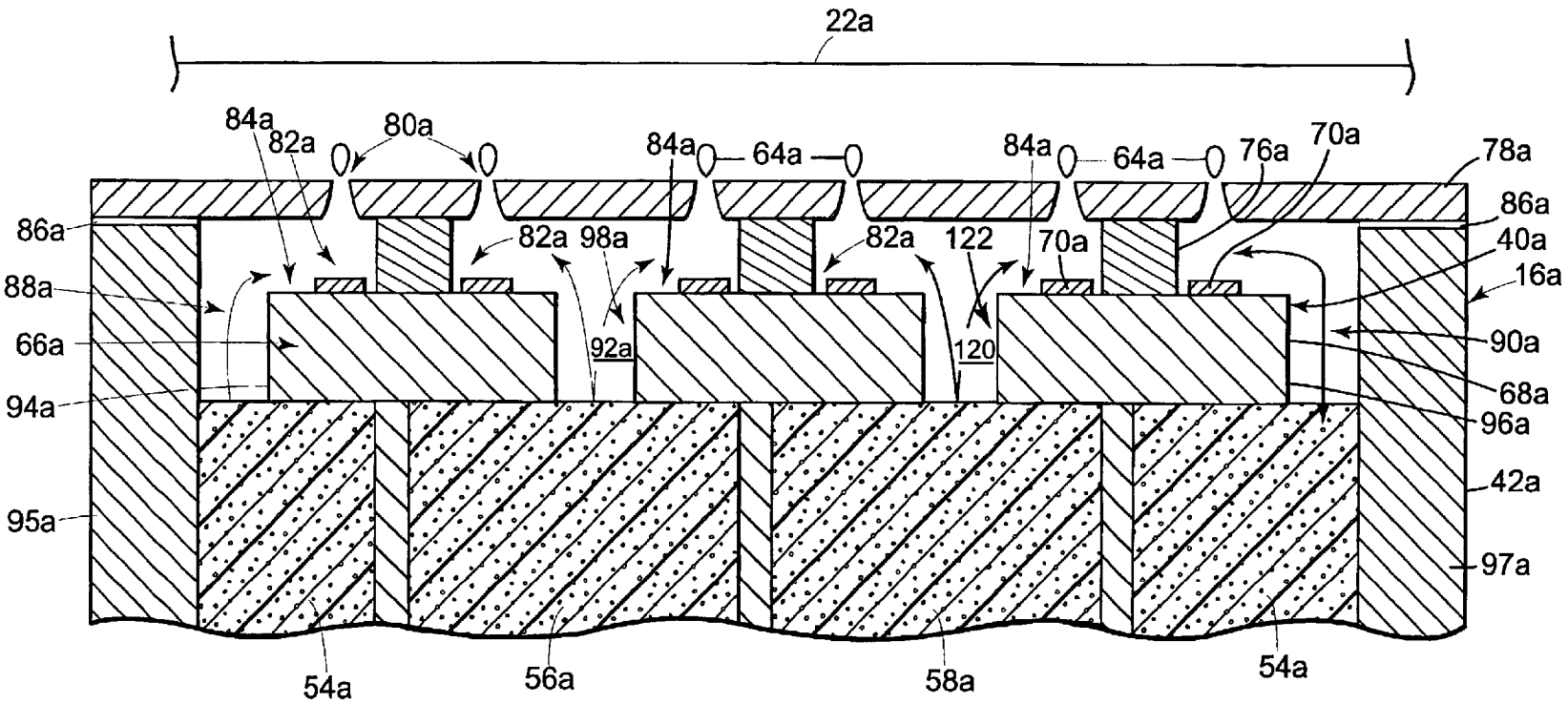
FIG. 7 is a partial sectional view of the alternative printhead die of FIG. 6 mounted to a multicolor printhead cartridge.

FIGS. 6 and 7 illustrate an alternative embodiment of an inkjet printhead die embodiment 40*a*. Like parts are labeled with like numerals except for the inclusion of the subscript "a". The alternative inkjet printhead 40*a* includes a fourth ink refill channel 120 defined by a further slot 122 extending through the base layer 68*a*. This fourth ink refill channel 120 and the third ink refill channel 92*a* are positioned between the first and second ink refill channels 88*a*, 90*a* and are parallel thereto. The fourth ink refill channel 120 is operatively associated with a fourth multiplicity or at least one column of firing resistors 70*a*. In one preferred embodiment, the fourth ink refill channel 120 is operatively associated with a fourth multiplicity of firing resistors 70*a* defined by two columns 124 and 126 of firing resistors 70*a* immediately adjacent to each side of the slot 122 extending through the base layer 68*a* via respective ink feed passageways 84*a*. The first and second ink refill channels 88*a*, 90*a* fluidically communicate with the first capillary member 54*a*, while the third and fourth ink refill channels 92*a*, 120 fluidically communicate with the second and third capillary members 56*a*, 58*a*, respectively, such that the first and second columns 100*a*, 102*a* of firing resistors 70*a* eject a first ink color (i.e., cyan), the third and fourth columns 104*a*, 106*a* of firing resistors 70*a* eject a second ink color (i.e., magenta), and the fifth and six columns 124, 126 of firing resistors 70*a* eject a third ink color (i.e., yellow). Such a printhead die 40*a* would be comparable to some typical slotted printhead dies that include two columns of firing resistors for each of three slots.

In one embodiment, the printhead die 40*a* is smaller in size than a typical three slot printhead die. In particular, the printhead die 40*a* of the present invention exhibits a 300 $\mu$m width reduction, based upon an average ink refill slot width of 300 $\mu$m due to the elimination of one slot.

The inkjet printhead dies 40, 40*a* of the present invention can be incorporated into existing inkjet printhead cartridges used in thermal inkjet printing systems 10.

Although the present invention has been described with reference to preferred embodiments, those skilled in the art will recognize that changes may be made in form and detail without departing from the spirit and scope of the invention.

What is claimed is:

1. A printhead comprising:

a substrate having at least one peripheral edge, the substrate including:

a plurality of fluid heating elements; and a plurality of fluid channels that deliver fluid to the plurality of fluid heating elements, wherein the plurality of fluid channels includes:

at leash one edgefeed fluid channel defined by the at least one peripheral edge; and at least one slot feed fluid channel.

2. The printhead of claim 1 wherein the at least one edgefeed fluid channel includes:

a first fluid channel operatively associated with a first multiplicity of fluid heating elements of the plurality of fluid heating elements, the first fluid channel defined by a first peripheral edge of the at least one peripheral edge;

a second fluid channel operatively associated with a second multiplicity of fluid heating elements of the plurality of fluid heating elements, the second fluid channel defined by a second peripheral edge of the at least one peripheral edge; and wherein the at least one slot feed fluid channel includes:

a third fluid channel operatively associated with a third multiplicity of fluid heating elements of the plurality of fluid heating elements, the third fluid channel defined by a slot extending through the substrate.

3. The printhead of claim 2 wherein the at least one slot feed fluid channel further includes:

a fourth fluid channel operatively associated with a fourth multiplicity of fluid heating elements oft e plurality of fluid heating elements, the fourth fluid channel defined by a further slot extending through the substrate.

4. The printhead of claim 2 wherein the first multiplicity of fluid heating elements are arranged in a first column immediately adjacent to the first peripheral edge of the substrate, wherein the second multiplicity of fluid heating elements are arranged in a second column immediately adjacent to the second peripheral edge of the substrate, and wherein the third multiplicity of fluid heating elements are arranged in at least one column immediately adjacent to the lot extending through the substrate.

5. The printhead of claim 4 wherein the at least one column is a column on each side of the slot.

6. The printhead of claim 2 wherein the substrate includes:

a base layer having the first, second and third multiplicity's of fluid heating elements;

a barrier layer adjacent the base layer, the barrier layer defining a plurality of firing chambers associated with the first, second and third multiplicity's of fluid heating elements, and defining fluid feed passageways that deliver fluid to the first, second and third multiplicity's of fluid heating elements; and a top plate adjacent the barrier layer, the top plate defining nozzles associated with the first, second and third multiplicity's of fluid heating elements.

7. The printhead of claim 6 wherein the top plate is oversized to allow the printhead to be mounted to printhead cartridge body, wherein the base layer includes the slot defining the third fluid channel, and wherein the first and second peripheral edges of the substrate are defined by firs and second peripheral edges of the base layer, such that the first and second peripheral edges of the base layer together with the printhead cartridge body define the first and second channels.

8. The printhead of claim 2 wherein the first fluid channel delivers fluid of a first color to the first multiplicity of fluid heating elements, wherein the second fluid channel delivers fluid of a second color to the second multiplicity of fluid heating elements, wherein the third fluid channel delivers fluid of a third color to the third multiplicity of fluid heating elements, and wherein the first, second and third colors are all different from one another.

9. The printhead of claim 2 wherein the first, second and third fluid channels deliver fluid of the same color to the first, second and third multiplicity's of fluid heating elements.

10. A printhead cartridge for printing system having a fluid supply for supplying fluid to the printhead cartridge, the printhead cartridge comprising:

a cartridge body; and a printhead die coupled with the cartridge body, the printhead die including: a substrate having at least one peripheral edge, the substrate including:

a plurality of firing resistors; and a plurality of fluid channels for delivering fluid to the plurality of firing resistors, wherein the plurality of fluid channels includes:

at least one edgefeed fluid channel defined by the at least one peripheral edge between the cartridge body and the printhead die; and at least one slot feed fluid channel.

11. The printhead cartridge of claim 10 wherein the at least one edgefeed fluid channel includes:

a first fluid channel operatively associated with a first multiplicity of firing resistors of the plurality of firing resistors, the first fluid channel defined between a first edge of the printhead die and the cartridge body;

a second fluid channel operatively associated with a second multiplicity of firing resistors of the plurality of firing resistors, the second fluid channel defined between a second edge of the printhead die and the cartridge body; and wherein the at least one slot feed fluid channel includes:

a third fluid channel operatively associated with a third multiplicity of firing resistors of the plurality of firing resistors, the third fluid channel defined by a slot extending through the printhead die.

12. The printhead cartridge of claim 11 wherein the at least one slot feed fluid channel further includes:

a fourth fluid channel operatively associated with a fourth multiplicity of firing resistors of the plurality of firing resistors, the fourth fluid channel defined by a further slot extending through the printhead die.

13. The printhead cartridge of claim 11 wherein the first fluid channel delivers fluid of a first color to the first multiplicity of firing resistors, wherein the second fluid channel delivers fluid of a second color to the second multiplicity of firing resistors, wherein the third fluid channel delivers fluid of a third color to the third multiplicity of firing resistors, and wherein the first, second and third colors are all different from one another.

14. The printhead cartridge of claim 11 wherein the first, second and third fluid channels deliver fluid of the same color to the first, second and third multiplicity's of firing resistors.

15. A fluid delivery system comprising:

a substrate including:

a plurality of fluid heating elements;

an edgefeed fluid delivery feature for delivering fluid around the substrate to the plurality of fluid heating elements; and a slot feed fluid delivery feature for delivering fluid through the substrate to the plurality of fluid heating elements.

16. The fluid delivery system of claim 15 wherein the edgefeed fluid delivery feature delivers fluid to a first multiplicity of fluid heating elements of the plurality of fluid heating elements, and wherein the slot feed fluid delivery feature delivers fluid to a second multiplicity of fluid heating elements of the plurality of fluid heating elements that is different than the first multiplicity of heating elements.

17. The fluid delivery system of claim 16 wherein the edgefeed fluid delivery feature delivers a first fluid to the first multiplicity of fluid heating elements, and wherein the slot feed fluid delivery feature delivers a second fluid, different from the first fluid, to the second multiplicity of fluid heating elements.

18. The fluid delivery system of claim 15 wherein the edgefeed fluid delivery feature is a pair of edgefeed fluid delivery features.

19. The fluid delivery system of claim 18 wherein the slot feed fluid delivery feature is a pair of slot feed fluid delivery features.

20. The fluid delivery system of claim 15 wherein the slot feed fluid delivery feature is a pair of slot feed fluid delivery features.

21. A printhead comprising:

a substrate including:

a first row of heating elements;

a second row of heating elements;

a third row of heating elements;

a fourth row of heating elements;

a single slot fed fluid delivery channel for delivering fluid to the first and third rows of heating elements;

a first edgefeed fluid delivery channel for delivering fluid to the second row of heating elements; and a second edgefeed fluid delivery channel for delivering fluid to the fourth row of the heating elements.

22. The printhead of claim 21 wherein the first edgefeed fluid delivery channel delivers a first fluid to the second row of firing resistors, wherein the second edgefeed fluid delivery channel delivers a second fluid to the fourth row of firing resistors, wherein the single slot feed fluid delivery channel delivers a third fluid to the first and third rows of firing resistors.

23. The printhead of claim 22 wherein the first fluid is a first color, the second fluid is a second color, and the third fluid is a third color.

24. A method of delivering fluid comprising the steps of:

providing a substrate having a plurality of fluid heating elements;

delivering fluid via edgefeed fluid delivery feature of the substrate to the plurality of fluid heat g elements; and delivering fluid via a slot feed fluid delivery feature of the substrate to the plurality of fluid heating elements, wherein only the slot feed fluid delivery feature passes through the substrate.

25. The method of claim 24 wherein the slot feed fluid delivery feature is a pair of slot feed fluid delivery features.

26. The method of claim 24 wherein the edgefeed fluid delivery feature is a first edgefeed fluid delivery feature and a second edgefeed fluid delivery feature.

27. The method of claim 26 wherein delivering fluid via the first edgefeed fluid delivery feature includes delivering a first fluid to a first multiplicity of the plurality of fluid heating elements, wherein delivering fluid via the second edgefeed fluid delivery feature includes delivering a second fluid to a second multiplicity of the plurality of fluid heating elements, and wherein delivering fluid via the slot feed fluid delivery feature includes delivering a third fluid to a third multiplicity of the plurality of fluid heating elements.

* * * * *

UNITED STATES PATENT AND TRADEMARK OFFICE

CERTIFICATE OF CORRECTION

PATENT NO. : 6,974,205 B2
APPLICATION NO. : 09/795344
DATED : December 13, 2005
INVENTOR(S) : Simon Dodd It is certified that error appears in the above-identified patent and that said Letters Patent is hereby corrected as shown below:

In column 3 & 4, lines 15-67 & 1-30 respectively, below "channel." delete "In one aspect of the present invention, the plurality of fluid channels includes first, second and third fluid channels. The first fluid channel is operatively associated with a first multiplicity of fluid heating elements of the plurality of fluid heating elements, with the first fluid channel being defined by a first edge of the substrate. The second fluid channel is operatively associated with a second multiplicity of fluid heating elements of the plurality of fluid heating elements, with the second fluid channel being defined by a second edge of the substrate. The third fluid channel is operatively associated with a third multiplicity of fluid heating elements of the plurality of fluid heating elements, with the third fluid channel being defined by a slot extending through the substrate. In a further aspect of the present invention, the first fluid channel delivers ink of a first color to the first multiplicity of fluid heating elements, the second fluid channel delivers ink of a second color to the second multiplicity of fluid heating elements, and the third fluid channel delivers ink of a third color to the third multiplicity of fluid heating elements. In still a further aspect of the present invention, the first, second and third fluid channels deliver ink of the same color to the first, second and third multiplicity's of fluid heating elements.

In another embodiment, the present invention provides a printhead cartridge for a printing system having a fluid supply for supplying fluid to the printhead cartridge. The printhead cartridge includes a cartridge body, and a printhead die mounted to the cartridge body. The printhead die includes a plurality of firing resistors. A plurality of fluid channels deliver fluid to the plurality of firing resistors. The plurality of fluid channels includes at least one edgefeed fluid channel and at least on slot feed fluid channel.

In a further embodiment, the present invention provides a fluid delivery system that comprises a substrate including a plurality of fluid heating elements. The substrate includes an edgefeed fluid delivery feature for delivering fluid to the plurality of fluid heating elements, and a slot feed fluid delivery feature for delivering fluid to the plurality of fluid heating elements.

In still another embodiment, the present invention provides a printhead comprising a substrate that includes first, second, third and fourth rows of firing resistors. The substrate also includes a single slot feed fluid delivery channel for delivering fluid to at least the first row of firing resistors, and at least one edgefeed fluid delivery channel for delivering fluid to at least the second row of firing resistors.

In still a further embodiment, the present invention provides a method of delivering fluid comprising the steps of providing a substrate having a plurality of fluid heating elements, delivering fluid via an edgefeed fluid delivery feature of the substrate to the plurality of fluid heating elements, and delivering fluid via a slot feed fluid delivery feature of the substrate to the plurality of fluid heating elements.

This printhead die substantially minimizes the size, strength and waste issues associated with present slotted printhead dies. In particular, the first, second and third fluid channels of the printhead die of the present invention permits three color printing with a printhead die having only a single slot as compared to the three slots needed for three color printing in a typical slotted printhead die. The elimination of two slots allows the printhead die of the present invention to exhibit an overall size reduction, as well as an increase in strength and a reduction in waste. In addition, the printhead die of the present invention substantially eliminates the single ink color or two ink color limitations of typical edgefeed printhead dies. Moreover, the printhead die of the present invention provides the above features throughout the useful life of the printhead cartridge to which the printhead die is mounted so as to preclude premature replacement of the printhead cartridge and the associated cost. Lastly, the printhead die of the present invention is relatively easy and inexpensive to manufacture, and is relatively simple to incorporate into printhead cartridges used in thermal inkjet printing systems."

In column 4, line 52, delete "p an" and insert -- plan --, therefor.

In column 8, line 34, in Claim 1, delete "leash" and insert -- least --, therefor.

In column 8, line 58, in Claim 3, delete "oft e" and insert -- of the --, therefor.

In column 9, line 2, in Claim 4, delete "lot" and insert -- slot --, therefor.

In column 9, line 19, in Claim 7, after "mounted to" insert -- a --.

In column 9, line 22, in Claim 7, delete "firs" and insert -- first --, therefor.

In column 9, line 38, in Claim 10, after "for" insert -- a --.

In column 10, line 58, in Claim 21, delete "fed" and insert -- feed --, therefor.

In column 10, line 63, in Claim 21, after "row of" delete "the".

In column 11, line 10, in Claim 24, after "via" insert -- an --.

In column 11, line 11, in Claim 24, delete "heat g" and insert -- heating --, therefor.

Signed and Sealed this

Sixth Day of April, 2010

David J. Kappos

David J. Kappos
*Director of the United States Patent and Trademark Office*